United States Patent [19]

Pollinzi

[11] 4,131,232

[45] Dec. 26, 1978

[54] AUTOMATIC SHOWER DISPENSER

[76] Inventor: Angeline D. Pollinzi, 6425 Westlake, Dallas, Tex. 75214

[21] Appl. No.: 799,226

[22] Filed: May 23, 1977

[51] Int. Cl.[2] ..... B05B 7/24; B05B 9/00

[52] U.S. Cl. ..... 239/314; 239/379; 239/419; 239/427

[58] Field of Search ..... 239/306, 310, 314, 345, 239/379, 407, 418, 419, 424.5, 427, 433; 222/133, 181, 193, 561

[56] References Cited

U.S. PATENT DOCUMENTS

| | | | |
|---|---|---|---|
| 1,847,869 | 3/1932 | Fawcett | 239/314 |
| 2,071,960 | 2/1937 | Wilson | 222/561 X |
| 3,198,437 | 8/1965 | Faglie | 239/379 X |
| 3,409,230 | 11/1968 | Eelkema | 239/314 |

*Primary Examiner*—Johnny D. Cherry
*Attorney, Agent, or Firm*—Richards, Harris & Medlock

[57] ABSTRACT

The specification discloses a dispenser for automatically mixing controlled amounts of liquid additive to the shower water. The dispenser is attachable to the water inlet pipe of an ordinary shower head and includes a plastic refillable container for holding the liquid additive and dispensing it under the flow of gravity. A valve is positioned over the mouth of the receptacle for controlling the flow of liquid additive. A dispensing tube assembly communicates with the valve for allowing liquid additive to flow by gravity to a portion of the dispensing tube extending subjacent the nozzles of the shower head. A first series of discharge openings along the bottom portion of the dispensing tube assembly drips a continuous flow of liquid additive into the stream of shower water after it exits from the nozzle. In another embodiment, some of the spray of water exiting from the shower head is directed into a second series of openings along the portion of the dispensing tube adjacent the front of the shower head for mixing water and liquid additive and discharging it from the series of discharge openings on the bottom side of the dispensing tube.

8 Claims, 5 Drawing Figures

AUTOMATIC SHOWER DISPENSER

FIELD OF THE INVENTION

This invention relates to dispensers for automatically mixing a controlled flow of liquid into the flow path of another liquid, and, more particularly, to shower dispensers for adding a liquid additive to the shower water.

DESCRIPTION OF PRIOR ART

There have been numerous efforts in the prior art to provide suitable means for dispensing and mixing any one of a number of liquid additives to a shower. Liquid soaps, skin conditioners, bubble bath, scented bath oils and the like are often found to be conveniently used when mixed automatically with the water in which an individual is showering. The automatic dispensing of such liquid additives is safer and more convenient, since it eliminates the handling and storing of slippery bottles within the shower. A device which allows an individual to apply soap or other liquid additive to the shower water automatically is especially beneficial to someone who must hold onto a safety rail within the shower, or who otherwise risks losing his balance in using one or both hands for applying soap and washing.

One example of a prior automatic shower dispenser is disclosed in U.S. Pat. No. 3,713,585. This patent discloses a dispenser device which requires replacement of the entire shower head with the shower dispenser. The device includes push button means for forcing liquid soap or the like into the water mixing chamber prior to exiting from the shower head. The entire chamber would have to be drained in order to change the liquid additive to be dispensed. There is no means for providing a continuous controlled flow of additive.

Another shower dispenser device is disclosed in U.S. Patent No. 3,801,018. This patent again requires the replacement of the conventional shower head in order to dispense the liquid additive. The dispenser produces a flow of aerated water and includes means for blending or emulsifying liquid additives into such a stream of aerated water. Liquid additives are introduced through a hole drilled into the shower head adjacent the neck at a point just before the additive enters the mixing chamber. After the water and additive are mixed, the mixture strikes the parallel grooves near the exit of the shower head for aeration of the mixture. Again, no means are provided for providing a continuous controlled flow of liquid additive.

While it is thus seen to be well known in the art to provide structure for automatically dispensing a liquid additive with shower water, these prior art devices require replacement of a conventional shower head with a more elaborate combination dispenser-shower head. In addition, such prior art devices require the mixing of the liquid additive and water to take place in a separate mixing chamber within the modified shower head structure before the water exits the shower head. Such a turbulent mixing may produce unwanted foaming of the liquid additive and leave a deposit within the mixing chamber which requires the dispensing device to be serviced by routinely cleaning out such mixing chambers. The present invention overcomes these and other disadvantages associated with such prior art devices by providing an all plastic shower dispenser that is adaptable and easily installed on any existing shower head. The dispenser of the present invention allows the liquid additive to drip into the stream of shower water where it immediately mixes with the water without any unwanted foaming. The liquid additive is controlled by a valve for regulating a continuous flow of liquid additive. The present invention also provides a shower dispenser wherein the type of liquid additive may be conveniently changed by changing the plastic refillable container without disassembling or emptying the dispenser.

SUMMARY OF THE INVENTION

The present invention provides an automatic dispensing device attachable to a conventional shower head for introducing a controlled flow of liquid additive to the spray of water flowing from the openings in front of the shower head.

In accordance with one aspect of the present invention, a plastic container suitable for holding a quantity of liquid additive has an opening formed therein for filling and dispensing the additive. Means are provided for attaching the plastic container to the shower head so the additive may flow out of the container opening under the force of gravity. A valve is provided at the side of the container opening for controlling the flow of liquid additive. Finally, a dispensing tube assembly communicates with the valve for directing the flow of liquid additive to a plurality of discharge openings for dripping the additive into the flow of water exiting from the shower head.

In another aspect of the present invention, the dispensing tube assembly includes a first tubular portion for communicating with the valve, a second tubular portion for communicating with the first portion and extending to divergent tubular members. A third tubular portion communicates with the ends of the two diverging members, said third portion being located subjacent the openings in the shower head and including a plurality of discharge openings for dripping the liquid additive into the flow of water.

In yet another aspect of the present invention, a plastic container is provided for holding a quantity of liquid additive, said container having a central opening for the liquid additive. Means are provided for attaching the receptacle above the shower head, such that the liquid additive flows from the container opening under the force of gravity. A valve is attachable to the container opening for regulating the flow of liquid additive. A dispensing tube assembly communicating with the valve directs the flow of liquid additive to a first series of discharge openings formed within the dispensing tube assembly. Said dispensing tube assembly also includes a second series of inlet openings for admitting a flow of water from the shower head into the dispensing tube assembly, such that the water and liquid additive are mixed within the dispensing tube assembly and discharged through said first series of discharge openings.

BRIEF DESCRIPTION OF THE DRAWINGS

For a more complete understanding of the present invention and further objects and advantages thereof, reference is now made to the following description taken in conjunction with the following drawings.

DESCRIPTION OF THE PREFERRED EMBODIMENT

Figure 1:
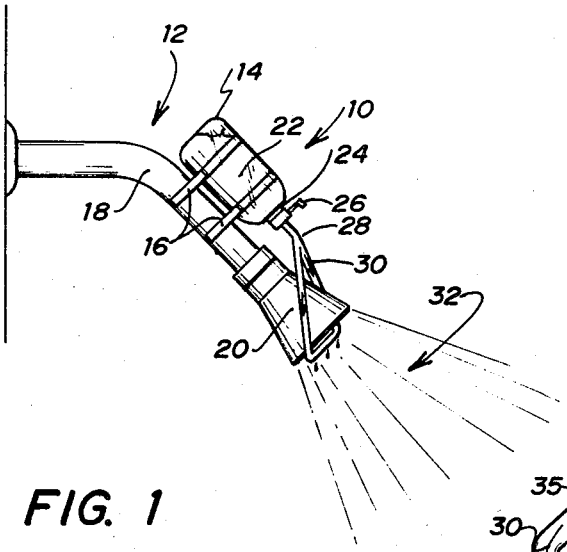
FIG. 1 is a side view of the preferred embodiment of the present invention.

FIG. 1 illustrates the preferred embodiment of the automatic shower dispenser, generally indicated by the reference numeral 10, attached in position to a conventional shower head assembly 12. The automatic shower dispenser 10 includes a refillable plastic container 14 secured by a pair of spring tension clamps 16 to a water inlet pipe 18. The container 14 is located above the shower head 20, so that the liquid additive 22 within the container 14 may flow downward under the force of gravity to the shower head 20.

The container 14 includes a central discharge opening 24, allowing the passage of the liquid additive 22 to the control valve 26, described more fully below in FIG. 3. The liquid additive 22 passing through the control valve 26 moves downwardly through the discharge tube assembly 28, as indicated by the arrows 30. The liquid additive 22 is not mixed with the shower water until the shower water exits from the shower head 20 as spray 32.

Figure 2:
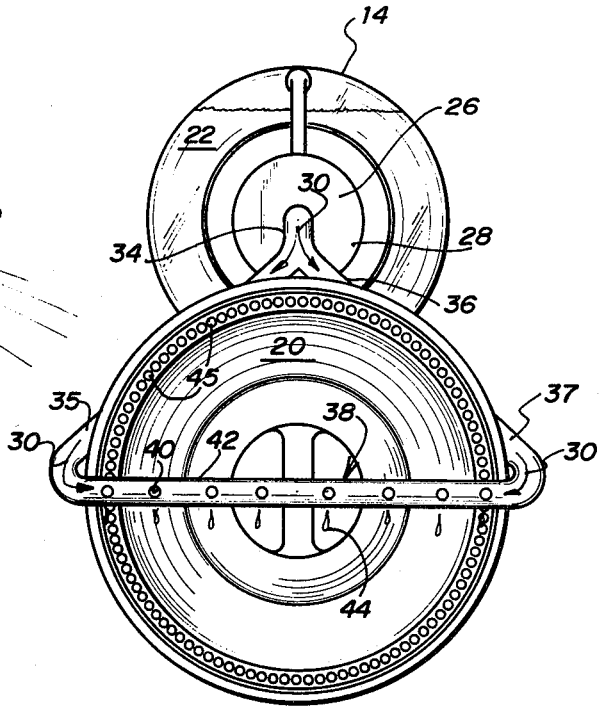
FIG. 2 is a front view of the preferred embodiment of the present invention.

FIG. 2 is a frontal view of the shower head 20 seen in FIG. 1. The plastic container 14 is illustrated above the shower head 20 and contains a quantity of liquid additive 22 to be added to the shower water. The liquid additive 22 is shown to flow under the direction of gravity through the discharge tube assembly 28 in the direction illustrated by the arrows 30. The discharge tube assembly 28 includes a first tubular portion 34 for communicating with the control valve 26. A second tubular portion 36 comprises a diverging pair of tubes 35 and 37 extending from the first tubular portion 34 down the sides of the shower head 20. A third tubular portion 38 communicates with the tubes 35 and 37 to form a completely closed passageway for the liquid additive 22. The tubular portion 38 includes a first series of discharge openings 40 spaced across the distal side 42 for releasing the flow of liquid additive 22 as a number of small droplets 44. The spray of water 32 exits from a plurality of openings 45 in the front of the shower head 20, and mixes with the droplets 44 of liquid additive 22. Of course, the tubular portion 38 of the discharge tube assembly 28 maya be formed in any geometric shape for releasing the desired pattern of liquid additive 22. For example, the tubular portion 38 might be arranged as a closed circle instead of the single tube extending between the second tubular portion 36. In addition, the discharge openings 40 formed within the tubular portion 38 of the discharge tube assembly 28 may be arranged in any number of patterns or consist of anynumber of openings to achieve the desired flow rate and discharge pattern for the liquid additive 22.

Figure 3:
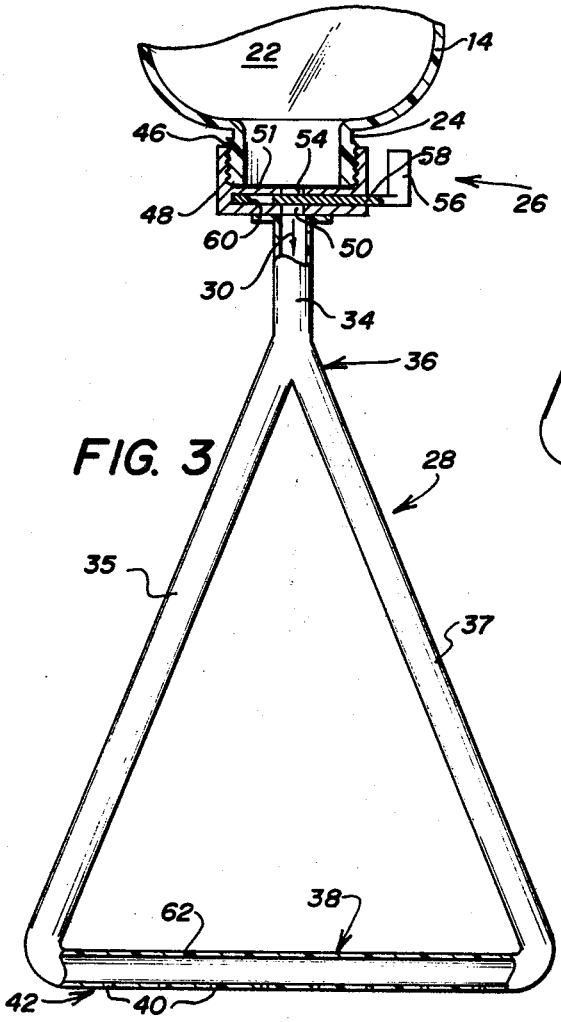
FIG. 3 is a partially broken away side view of the preferred embodiment of the present invention.

FIG. 3 is a partially broken away side view of the automatic shower dispenser 10. FIG. 3 illustrates a partially broken away container 14, oriented to allow a flow of liquid additive 22 under the action of gravity through the central discharge opening 24. The central discharge opening 24 extends to a threaded neck portion 46 which engages a correspondingly threaded housing member 48 of the control valve 26. The threaded housing member 48 includes a cental opening 50 formed therethrough as a passageway for the additive 22. A washer 51 having a central opening 54 and aligned with the opening 50 is shown positioned between the neck portion 46 and housing member 48. A slide bar 56 is adaptably received within a groove 58 formed in the housing member 48, allowing the slide bar 56 to be positioned so that its central opening 60 is aligned with the housing member 48 and opening 50 in either the fully opened, partially opened or fully closed position (illustrated).

In the partially opened or fully opened position, the control valve 26 allows liquid additive 22 to flow through the opening 50 of the housing 48 and to the first tubular portion 34 of the discharge tube assembly 28. The first tubular portion 34 extends to diverging tubes 35 and 37 for communicating a flow of liquid additive 22 to the third tubular portion 38 extending between the ends of the tubes 35 and 37. The tubular portion 38 extends across the face of the shower head 20 (FIG. 2) and has one side 62 proximally located subjacent the face of the shower head 20 and the other side 42 distal to the face of the shower head 20. The side 42 of the tubular portion 38 has a first series of discharge openings 40 formed therethrough for the release of a liquid additive 22.

Figure 4:
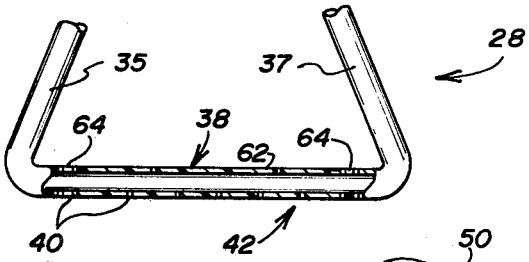
FIG. 4 is a partially broken away side view of an alternate embodiment of the dispensing tube assembly of the present invention.

FIG. 4 illustrates an alternative embodiment of the discharge tube assembly 28 and the third tubular portion 38 extending between the diverging pair of tubes 35 and 37. The side 62 of the tubular portion 38 located proximate to the shower head 20 has a second series of inlet openings 64 formed therethrough. The openings 64 may be arranged in any desired pattern, but preferably are arranged to be aligned with the openings 46 in the shower head 20. Thus, a flow of water is directed into the third tubular portion 38 for mixing water with the liquid additive 22. The mixture of water and liquid additive within the tubular portion 38 is discharged through the openings 40 formed in the distal side 42. In this alternate embodiment of the invention, the series of openings 40 within the tubular portion 38 may be directly aligned with some of the inlet openings 64 to thus force more of the water-additive mixture through the discharge tube assembly 28.

Figure 5:
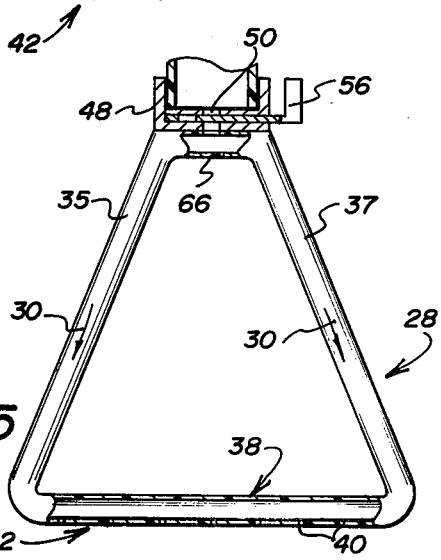
FIG. 5 is a side view of an alternate embodiment of the dispensing tube assembly of the present invention.

FIG. 5 illustrates another alternate embodiment of the discharge tube assembly 28. In this embodiment, a first tubular member 66 directs the liquid additive 22 flowing through opening 50 directly to the pair of discharge tubes 35 and 37. The liquid additive 22 then continues to flow under the force of gravity in the direction indicated by arrows 30 to be discharged through openings 40, as described above for FIG. 3.

It will be understood that the shower dispenser device 10 may be constructed of any suitable material, but preferably made from plastic. It will be further understood that the container 14 and the discharge tube assembly 28 may be made in any number of configurations.

Although preferred embodiments of the invention have been illustrated in the accompanying drawings and described in the foregoing detailed description, it will be understood that the invention is not limited to the embodiments disclosed, but is capable of numerous rearrangements, modifications, and substitution of parts and elements without departing from the spirit of the invention.

What is claimed is:

1. An automatic dispensing device attachable to a conventional shower head for introducing a controlled flow of liquid additive to the spray of water flowing from the openings in the front of the shower head, comprising:

a plastic container suitable for holding a quantity of the liquid additive, said container including an opening for receiving and discharging the liquid additive, means for attaching said container to the shower head such that the liquid additive may flow from said container opening under the force of gravity, a valve attachable to said opening of said container for controlling the flow of liquid additive, and a first tubular portion communicating with said valve, a second tubular portion communicating with said first portion and extendig to two diverging tubular members, and a third tubular portion communicating with the ends of said two diverging members, said third portion being located subjacent the openings in the shower head and including a plurality of discharge openings, such that the liquid additive drips under the force of gravity into the flow of water from the shower head.

2. The automatic dispensing device of claim, 1 wherein said discharge openings formed in said third tubular portion are located entirely on the side distal from the shower head.

3. The automatic dispensing device of claim 1 wherein said diverging tubular members of said second tubular portion are dimensioned to conform to the exterior sides of the shower head and said third tubular portion extends across the front of the shower head.

4. An automatic dispensing device attachable to a shower head for automatically dispensing a liquid additive within the pattern of water spraying from the openings formed in the front of the shower head, comprising:

a plastic container for holding a quantity of liquid additive, said container having an opening for receiving and discharging the liquid additive, means for attaching said container above the shower head, such that liquid additive flows from said container opening by the force of gravity, a valve attachable to said container opening for regulating the flow of the liquid additive, a dispensing tube assembly communicating with said valve for directing a flow of liquid additive to a first series of discharge openings formed within said dispensing tube assembly for dripping the liquid additive into the flow of water from the shower head, and said dispensing tube assembly having a second series of inlet openings for admitting a flow of water from the shower head into said dispensing tube assembly, such that water and liquid additive are mixed within the dispensing tube assembly and discharged through said first series of discharge openings.

5. The automatic dispensing device of claim 4 wherein said dispensing tube assembly is constructed entirely of plastic.

6. The automatic dispensing device of claim 4 wherein said dispensing tube assembly includes a first tubular portion communicating with said valve, a second tubular portion communicating with said first portion and extending to two diverging tubular members, and a third tubular portion extending between and communicating with the ends of said diverging tubular members of said second portion, said third tubular member being located subjacent the openings in the front of the shower head.

7. The automatic dispensing device of claim 6, wherein said inlet openings are located on the side of said third tubular portion proximal to the openings of the shower head and said discharge openings are located along the side of said third tubular member distal from the openings in the front of the shower head.

8. The automatic dispensing device of claim 7, wherein some of said inlet openings are aligned with some of said discharge openings for promoting the discharge of the mixture of water and liquid additive.

* * * * *